US006819705B2

(12) United States Patent
Fourie

(10) Patent No.: US 6,819,705 B2
(45) Date of Patent: Nov. 16, 2004

(54) INDUCTION FURNACE

(76) Inventor: Louis Johannes Fourie, 19 Monte Carlo Dr., Highveld X7, Centurion, Gauteng-Province (ZA)

( * ) Notice: Subject to any disclaimer, the term of this patent is extended or adjusted under 35 U.S.C. 154(b) by 0 days.

(21) Appl. No.: 10/312,057

(22) PCT Filed: Jun. 20, 2001

(86) PCT No.: PCT/IB01/01075

§ 371 (c)(1),
(2), (4) Date: Dec. 20, 2002

(87) PCT Pub. No.: WO01/99473

PCT Pub. Date: Dec. 27, 2001

(65) Prior Publication Data

US 2003/0103546 A1 Jun. 5, 2003

(30) Foreign Application Priority Data

Jun. 20, 2000 (ZA) ..... 2000/3089

(51) Int. Cl.[7] ..... H05B 6/16
(52) U.S. Cl. ..... 373/159; 373/162; 373/163
(58) Field of Search ..... 373/138, 159, 373/160, 161, 162, 163; 219/634, 647, 672

(56) References Cited

U.S. PATENT DOCUMENTS

| | | | | |
|---|---|---|---|---|
| 3,595,979 A | | 7/1971 | Shearman | |
| 4,021,602 A | * | 5/1977 | Delassus | 373/161 |
| 4,170,713 A | | 10/1979 | Butseniex et al. | |
| 4,174,462 A | * | 11/1979 | Pearce | 373/150 |
| 4,435,820 A | * | 3/1984 | Edgerley | 373/161 |
| 5,411,570 A | | 5/1995 | Fourie | |

FOREIGN PATENT DOCUMENTS

| | | | |
|---|---|---|---|
| CH | 27812 | 9/1951 | |
| GB | 575780 | 3/1946 | |
| WO | 01/99473 | 12/2001 | H05B/6/16 |

* cited by examiner

*Primary Examiner*—Tu Hoang
(74) *Attorney, Agent, or Firm*—Darby & Darby

(57) ABSTRACT

An induction-heated furnace having a shell with at least a portion lined with refractory material having walls and a floor. At least one induction heater is mounted to the floor of the furnace refractory material that communicates with the interior of the furnace through a throat. The throat length is substantially longer than the throat length of the induction heater to aid the distribution of molten metal in the furnace.

26 Claims, 8 Drawing Sheets

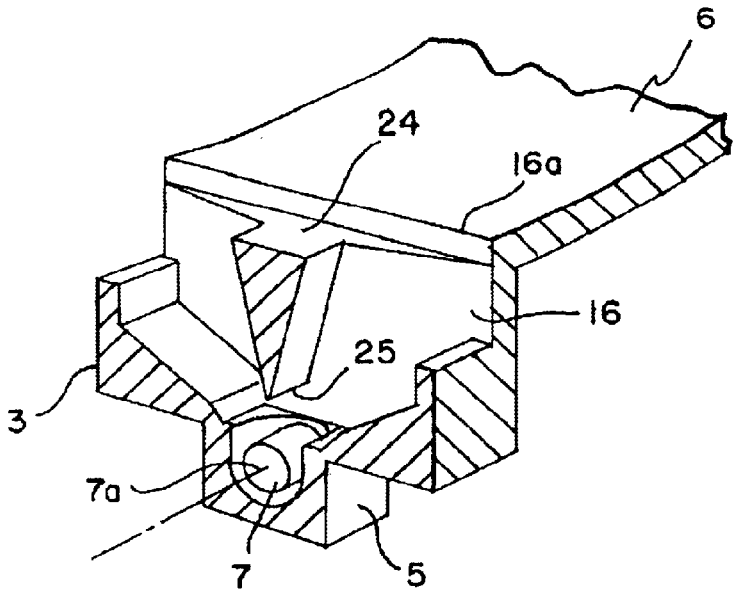
FIG. 6
FIG. 7
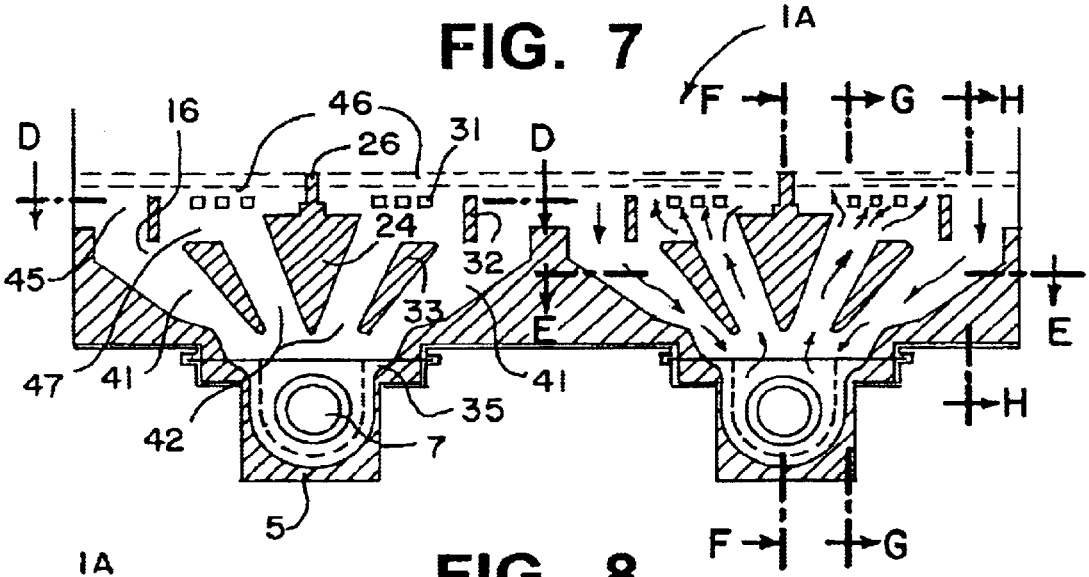
FIG. 8
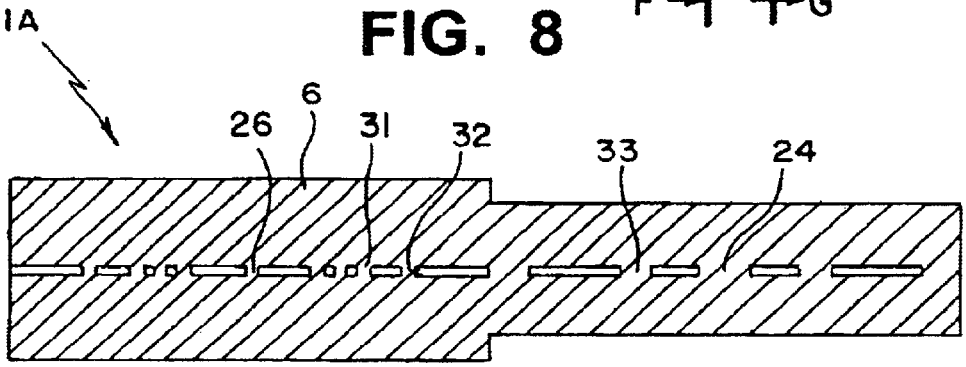

INDUCTION FURNACE

FIELD OF THE INVENTION

This invention relates to induction furnaces used in the melting or smelting of metals and particularly to induction furnaces used in steelmaking.

BACKGROUND TO THE INVENTION

In recent years there have been moves in the steelmaking industry to develop new steelmaking processes that are radically different compared to the traditional iron blast furnace and steelmaking-furnace routes.

In the traditional route steel is basically produced in two stages. In the first stage, which occurs in the blast furnace, iron oxide is reduced to pig iron. In the second stage, which occurs in the steelmaking furnace, elements such as carbon and manganese are controlled to specific levels and elements such as silicon, sulphur and phosphorous are mostly eliminated. Steelmaking furnaces include furnaces such as basic oxygen and electric arc furnaces.

One of the problems with the traditional method of making steel is the need to transfer liquid iron between the two stages of the process. The transfer involves a costly capital investment in infrastructure and also carries with it the risk associated with transporting liquid iron. The traditional methods are also associated with gas emissions that are not environmentally friendly.

A significant development in this area has been the development of a channel type induction furnace that is charged with an iron-containing burden and produces crude steel. This is the type of process described in U.S. Pat. No. 5,411,570 and patent applications PCT/EP97/01999 and PCT/IB99/01334.

The furnace is a channel type induction furnace and consists of a shell lined with refractory material. Feed material, iron containing ore and carbon reductant, is charged through holes in the sides of the furnace and is then heated by combustion of the different gases that are formed when a carbon reductant and ore mixture is heated, and under certain conditions, combustion of additional fuel.

Induction heaters situated at the bottom of the metal bath heat the liquid metal in the furnace which in turn heats the burden further and melts it to form liquid slag and metal. These heaters are attached to the furnace in the conventional manner. This means that the furnace has appropriate openings in its shell and flanges around the opening for bolting the complementary flange of the induction heater to the flange of the shell. Both the furnace and the induction heaters are lined with refractory material.

The thickness of the refractory material of the furnace around the induction heater opening in the furnace determines the depth of the entrance or 'throat' to the induction heater.

Molten metal flows into the induction heater through the throat and also exits the induction heater through it. The metal closest to the inner surface of the induction heater is heated. This means colder metal flows into the induction heater channels on the outside and is heated as it passes against the inside of the channel. Flow of the molten metal is generated by the difference in densities between hot and cold metal. Electromagnetic forces can assist this effect, to modify the flow pattern of the molten metal.

The known channel induction heaters are of the type that consists of an electrical coil that is built into a refractory body with a channel formed in the refractory material around the coil. The coil is isolated from the channel by refractory material, water-cooling panel(s) and an air gap. The combined depths of the refractory material on the floor of the furnace; the thickness of the furnace shell; the thickness of the furnace flange; and the distance between the furnace shell and the furnace flange is commonly accepted as the depth of the throat to the induction heater. The throat is shaped to be substantially vertical and it leads directly into the channels of the induction heater.

In the channel type furnace several of the induction heaters are arranged in a row along the length of the furnace.

The charge in the furnace consists of the molten metal bath, a layer of slag on top of the metal and the solid burden at the top. The burden is basically divided into two continuous heaps extending for the greater part of the length of the furnace, as described in U.S. Pat. No. 5,411,570; or the furnace can be charged so that the two continuous heaps of burden meet in the centre of the of the furnace to close the gap between the two heaps of burden, as described in patent application PCT/EP97/01999.

The molten metal flows into an induction heater through its throat and also exits the induction heater through its throat. The exit stream from the induction heater is substantially vertical, thereby mixing with the metal directly above the opening. The colder metal drawn into the induction heater also substantially originates from the pool of metal directly above the induction heater. The rising hot metal exchanges heat with the descending cold metal in the throat.

This means that the pool of metal above each induction heater opening and in the throat is to a large degree circulated through the induction heater and repeatedly heated. This causes local hotspots above the induction heater openings, especially when the depth of the metal bath above the induction heater is shallow. This causes the metal in the induction heater to be heated to unnecessarily, and some times dangerously, high temperatures.

The existence of local hotspots is not ideal in this type of furnace for a number of reasons. The first is that hotspots cause some of the burden in the vicinity of the hotspot to be preferentially melted, resulting in underexposure of that material to the heat from the burning gasses relative to the part of the burden not preferentially melted. Areas of overexposure and areas of underexposure to the heat from the burning gasses therefore exist. This difference in exposure leads to excessive electrical energy consumption and under utilisation of the available energy for reduction in the burning gasses and the heated roof. It also results in heating of unreduced burden that is too fast, leading to gas evolution in the liquid steel and subsequent undesirable boiling action. The effect of this is that the power input through the induction heaters must be reduced and as a result the production rate decreases.

In this specification the term "throat" shall mean the communication channel between the furnace and an induction heater in the floor of the furnace.

In this specification the term "throat depth" shall mean the operatively and substantially vertical distance from the uppermost extremity of the throat to a centre line drawn through the length of a coil of an induction heater in the floor of the furnace.

In this specification the term "service length" shall mean the length of the furnace that each induction heater is required to heat during use, which is the operatively and substantially horizontal distance from the mid-point between an induction heater and an adjacent induction heater to the mid-point between the induction heater and an oppositely adjacent induction heater or to the end of the furnace.

In this specification the term "throat length" shall mean the horizontal distance from one side of the throat of an induction heater, across the channels and the coil of the induction heater to its other side; this distance is measured substantially parallel to the "service length" of the induction heater.

In this specification the term "throat width" shall mean the distance between sidewalls of the throat and this distance is measured transverse to the "throat length".

In this specification the term "induction heater channel width" shall mean the approximate distance from one side wall of the induction heater channel to the opposite side wall, measured at the centreline of the induction heater and measured at right angles to the long axis of the induction heater.

In this specification the term "conventional throat depth" shall mean, for a conventional induction furnace used for a similar process than that of the invention, the combined thickness of the floor refractory, the furnace shell supporting the floor, the distance between the furnace shell and the furnace flange, the thickness of the furnace and induction heater flanges, the thickness of the packing between the furnace and induction heater flanges, the distance between the induction heater flange and the induction heater shell, the induction heater shell, and the thickness of the induction heater refractory material from the induction heater shell upper inside surface to a level parallel with a centre line through the induction heater coil.

OBJECT OF THE INVENTION

It is an object of this invention to provide a throat for a channel type induction heated furnace that at least partly alleviates some of the problems mentioned above.

SUMMARY OF THE INVENTION

In accordance with this invention there is provided for an induction-heated furnace comprising a shell lined with refractory material;

the furnace having at least walls and a floor;

with at least one induction heater located in the floor of the furnace;

the induction heater communicating with the interior of the furnace through a throat;

the throat length being more than at least half of the service length of the induction heater.

There is also provided for an induction heated furnace to comprise a shell lined with refractory material;

the furnace having at least walls and a floor with at least one induction heater located in the floor of the furnace;

the induction heater communicating with the interior of the furnace through a throat; and the throat width being not more than three times the induction heater channel width, such throat width being substantially less than the width of a conventional throat in an induction heated furnace.

There is also provided for an induction heated furnace to comprise a shell lined with refractory material;

the furnace having at least walls and a floor;

with at least one induction heater located in the floor of the furnace;

the induction heater communicating with the interior of the furnace through a throat; and the throat depth being substantially more than the throat depth of a conventional induction heated furnace used for the same process.

There is also provided for an induction heated furnace to comprise a shell lined with refractory material;

the furnace having at least walls and a floor;

with at least one induction heater located in the floor of the furnace;

the induction heater communicating with the interior of the furnace through a throat;

the interior at least partly filled with liquid metal; and the level of liquid metal in the furnace being substantially less than the level of liquid metal in a conventional induction heated furnace used for the same process.

There is also provided for the furnace to be a channel type furnace;

for the furnace to be used in the melting, alternatively smelting, of metals, for the furnace to have at least one charge hole for burden, at least one tap hole, and at least one gas burner inside the furnace.

There is further provided for the furnace to be a channel type furnace;

for the furnace to be used in steelmaking;

for the furnace to have at least one charge hole for iron containing burden, alternatively iron containing burden and reducing material, at least one tap hole, and at least one gas burner inside the furnace.

There is further provided for the burden to be scrap metal, for the burden to include reducing material and for the burden to include other raw materials.

There is also provided for the throat to have at least one baffle above the centre of the induction heater;

for the baffle to be built into the side walls of the throat; and for the baffle to direct the flow of molten metal through the throat.

There is further provided for the throat to have baffles spaced throughout the throat;

for the baffles to be built into the side walls of the throat; and for the baffles to direct the flow of molten metal through the throat.

There is further provided for the baffles to be preferably wedge shaped with the apex of the wedge directed to the centre of the induction heater.

There is also provided for the central baffle to have a weir on its operatively upper surface and for the weir to extend above the level of molten metal in the furnace.

There is further provided for a conduit to extend through the baffle and for the conduit to be a cooling conduit.

A further feature of the invention provides for an induction heated furnace as above, wherein the throat comprises at least two molten metal transport channels, the first channel communicating with a first portion of the molten bath above the induction heater, and the second channel communicating with a second portion of the molten bath remote from the first portion of the molten bath.

There is further provided for the throat to comprise three molten metal transport channels, for the second and third molten metal channels to respectively communicate with second and third portions of the molten bath remote from the first portion of the molten bath, and for the first portion of the molten bath to be located between the second and third portions of the molten bath.

The invention further provides for the operatively upper end of the first channel to include a manifold, for the manifold to be connected with a plurality of manifold passages, and for the passages to communicate with the operatively upper region of the first portion of the molten bath.

There is also provided for the passages to extend through a raised portion of the furnace floor.

A still further feature of the invention provides for the first channel to operatively channel molten metal from the induction heater to the molten bath, and for the second and third channels to operatively channel molten metal from the molten bath to the induction heater.

BRIEF DESCRIPTION OF THE DRAWINGS

In the drawings:

Embodiments of the invention will be described by way of example only and with reference to the accompanying drawings in which:

FIG. 6 shows a perspective view of a section of the furnace floor throat and channel.

FIG. 7 shows a longitudinal section of another furnace incorporating the invention.

FIG. 8 shows a staggered plan view of the furnace in FIG. 7 along the lines 8—8.

DETAILED DESCRIPTION WITH REFERENCE TO THE DRAWINGS

Figure 12:
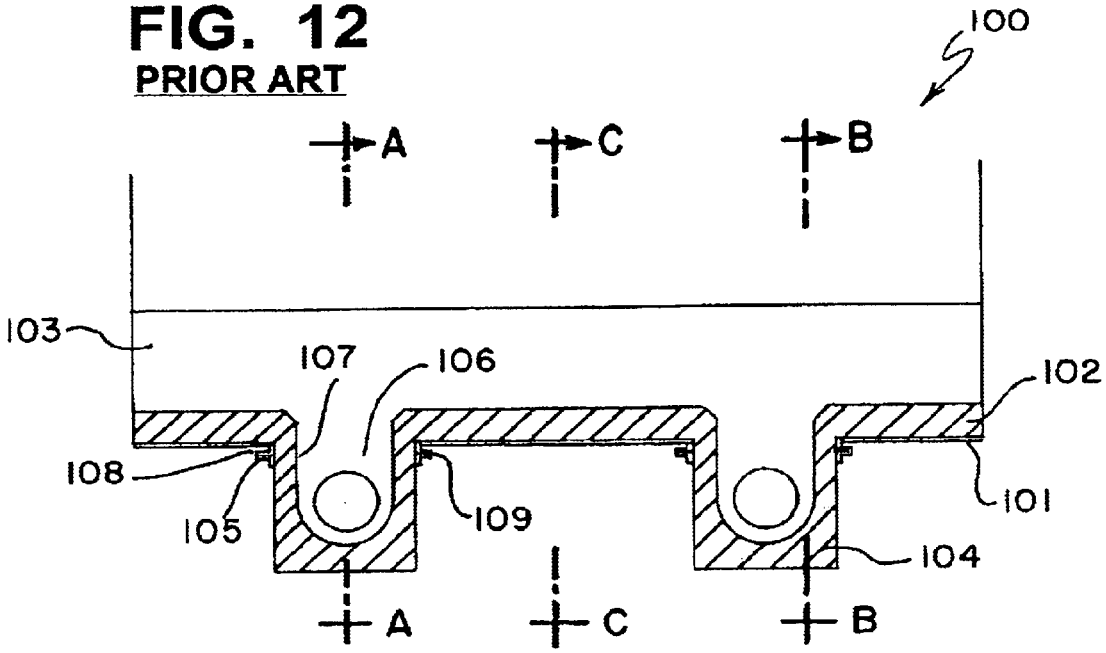
FIG. 12 PRIOR ART
FIG. 12 is a section through a furnace according to the prior art.
Figure 13:
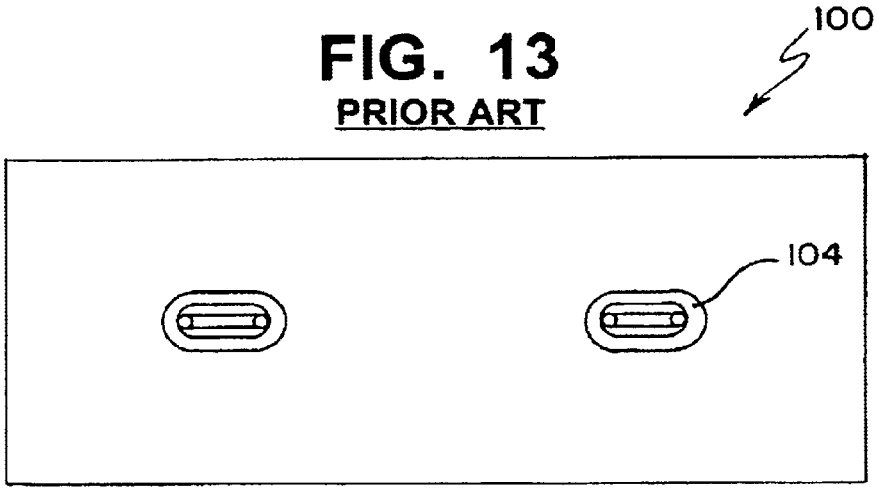
FIG. 13 PRIOR ART
FIG. 13 is a plan view of the furnace in FIG. 12.
Figure 14:
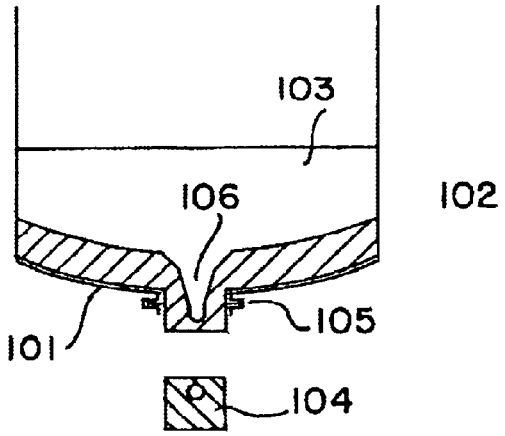
FIG. 14 PRIOR ART
FIG. 14 is a section through 14—14 in FIG. 12.
Figure 15:
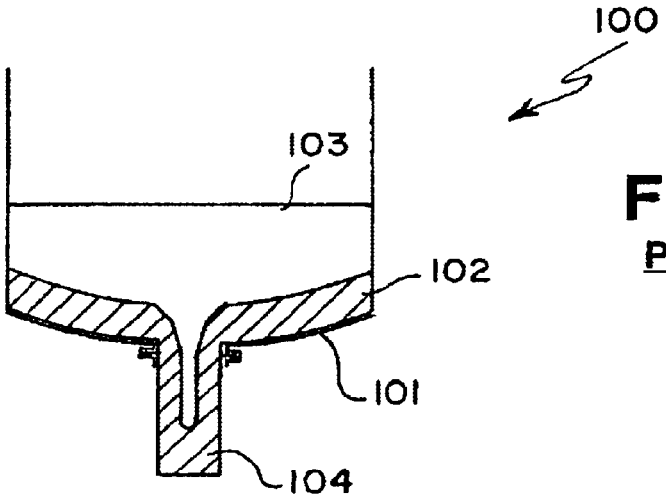
FIG. 15 PRIOR ART
FIG. 15 is a section through 15—15 in FIG. 12.
Figure 16:
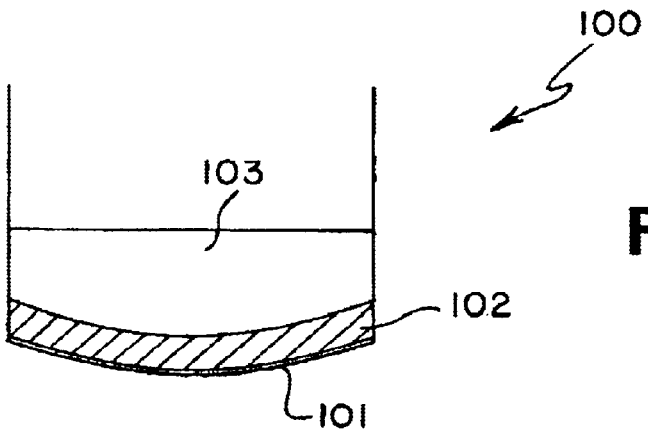
FIG. 16 PRIOR ART
FIG. 16 is a section through 16—16 in FIG. 12.

A furnace (100) incorporating the prior art is shown in FIG. 12. A plan view of the furnace (100) is shown in FIG. 13. The furnace (100) has steel shell (101) partly shown lined with refractory material (102) partly shown for insulation and containment of molten steel (103) in the furnace (100).

In the centre of the furnace (100) there is a row of induction heaters (104) of which two is shown in this FIGS. 12 and 13. The induction heaters (104) are attached to the steel shell (101) of the furnace (100) by means of complementary flanges (105*a*, 105*b*) on the furnace (100) and the induction heaters (104) that are secured to each other. Normally the flanges (105*a*, 105*b*) are bolted together to secure them to each otter.

The furnace (100) and each induction heater (104) are in communication with each other through a throat (106). The depth of the throat (106) is basically determined by the distance from the uppermost surface of the refractory (102) on the floor of the furnace (100) to the joint (109) between the furnace (100) and the induction heater (104). This depth is more accurately defined as the combined thickness of the refractory material (102) on the floor of the furnace (100), the steel shell of the furnace (101), the gap (108) between the furnace shell and the furnace flange (105*a*), and the thickness of the furnace flange (105*a*).

In the prior art the throat depth would vary when any one or more of the above mentioned dimensions were varied. The basic purpose of the throat was to be a passage for the metal to flow between the furnace and the induction heater. This type of induction furnace is described in patent application PCT/IB99/01334.

Figure 1:
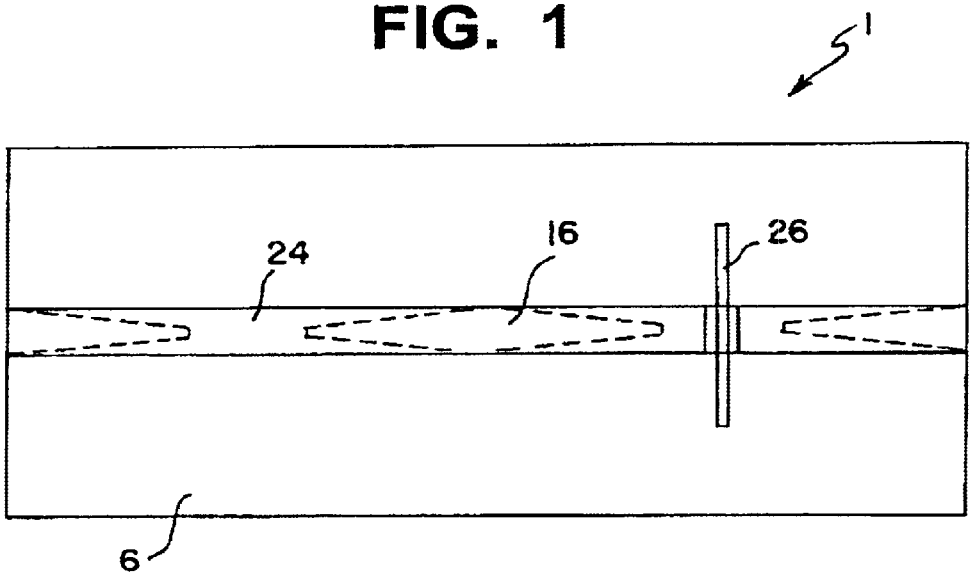
FIG. 1 shows a plan view of a furnace incorporating the invention.
Figure 2:
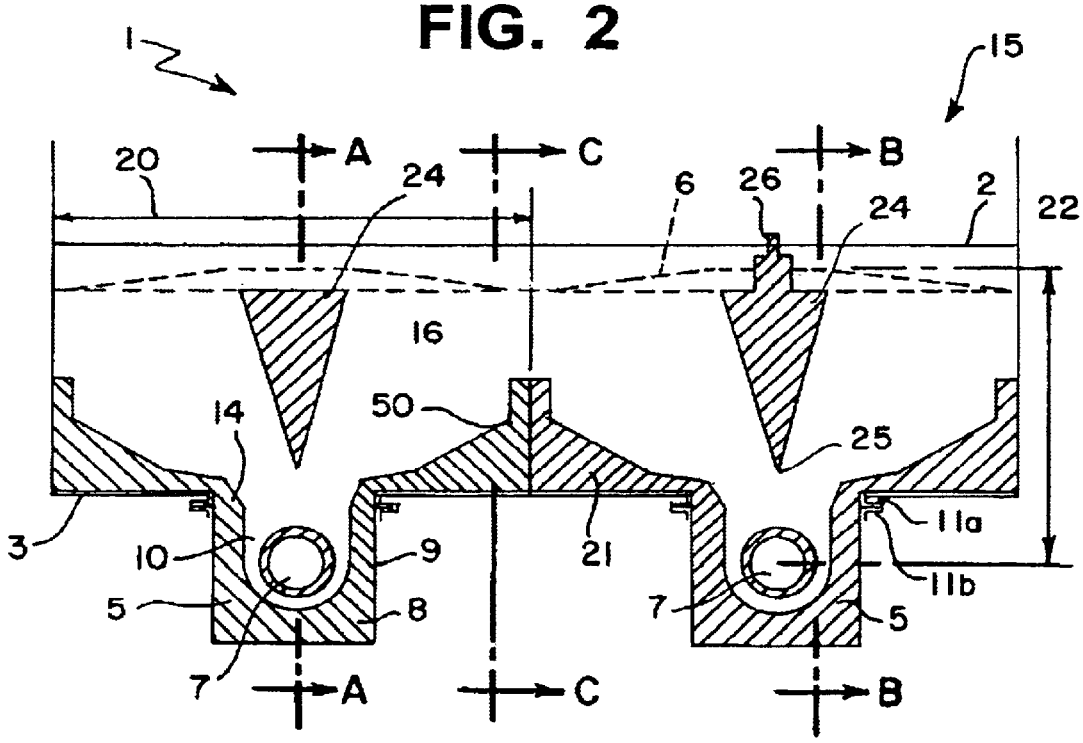
FIG. 2 shows a longitudinal section of the furnace in FIG. 1 through the induction heaters and throats.
Figure 3:
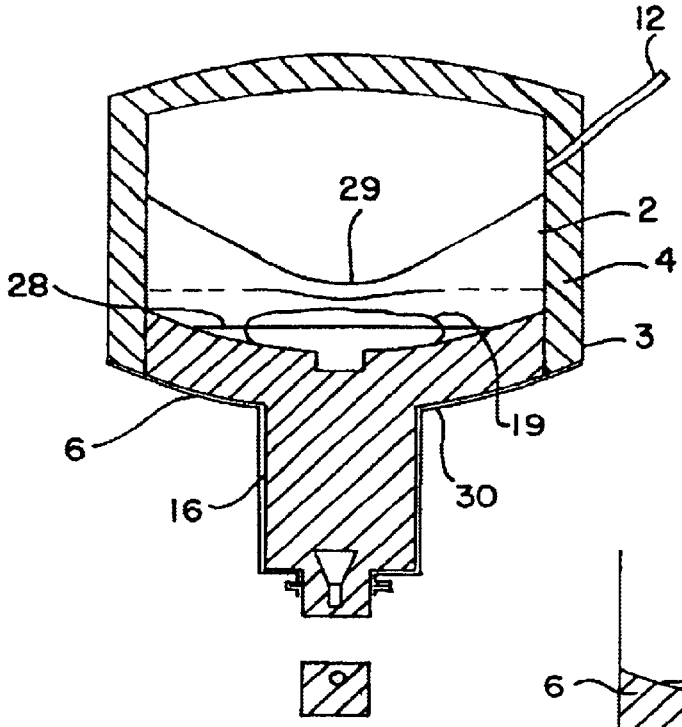
FIG. 3 is a section through 3—3 in FIG. 2.

FIGS. 1 and 2 shows an induction heated channel furnace (1) incorporating the invention. The furnace is used in the reduction of iron ore burden (2) as shown in FIG. 3. The charging and operation of the furnace (1) is described in U.S. Pat. No. 5,411,570 and patent applications PCT/EP97/01999 and PCT/IB99/01334.

With this invention the furnace (1) also has a steel shell (3), which is lined with refractory material (4) on the inside for containment and insulation purposes. The burden (2) in the furnace is heated by radiation from flames created by burning gas and by radiation from the roof of the furnace. The metal bath is heated by two induction heaters (5) attached to the furnace (1) in the middle of the floor (6).

The induction heaters (5) each comprise a coil (not shown) passing through a cavity (7) located in refractory material (8) that fills the induction heater shell (9). A channel (10) is formed in the induction heater refractory material (9) around the cavity (7).

The induction heaters (5) are attached to the furnace shell (3) by means of bolts (not shown) that join complementary shaped flanges on the furnace (11*a*) and induction heaters (11*b*).

The induction heater channels (10) communicate with the furnace interior (15) through a throat (16). The depth (22) of the throat (16) is defined as the distance from the upper surface (16A) of the throat (16) at the furnace floor (6) to the joint between the furnace (11A) and the induction heater (11B). This distance is substantially more than the similarly defined distance in a conventional furnace such as described in U.S. Pat. No. 5,411,570 and patent applications PCT/EP97/01999 and PCT/IB99/01334. The length (20) of each throat (16) is shown in FIG. 2.

Each throat (16) also has sidewalls (23). The average distance (not shown) between the sidewalls (23) is defined as the throat width. The throat width is less than three times the channel width of the induction heater (5).

Extending between the sidewalls (23) in the throat (16) is a baffle (24) above each induction heater (5).

The baffles are generally wedge shaped with the apex of each wedge (25) pointing down towards an induction heater (5). The apex (25) of each baffle (24) extends to close above the furnace-induction heater joint (14).

On top of one baffle (24) there is a weir (26) built onto the flat upper surface (27) of the baffle (24). The weir (26) is high enough to extend above the bath level (28) in the furnace (1) and it also extends from side to side in the furnace, thereby preventing or restricting movement of liquid steel over the baffle (24). It (26) does not restrict the flow of slag from one side of the furnace (1) to the other side and it (26) may have a breach (not shown) through it to allow restricted metal flow over the baffle (24).

Figure 4:
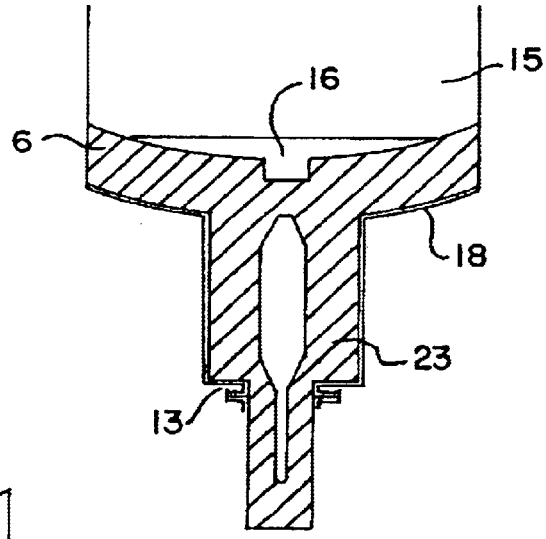
FIG. 4 is a section through 4—4 in FIG. 2.
Figure 5:
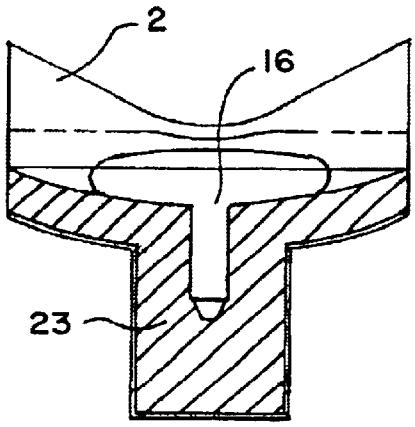
FIG. 5 is a section through 5—5 in FIG. 2.

The furnace is also shown in plan view in FIG. 1 and sections through the furnace are shown in FIGS. 3, 4 and 5 to further explain the layout of the furnace. The perspective view in FIG. 6 further exemplifies the configuration of the throat (16), baffle (24) and induction heaters (5).

The furnace (1) is operated in a similar way as disclosed in U.S. Pat. No. 5,411,570 and patent applications PCT/EP97/01999 and PCT/IB99/01334. The furnace is charged with iron bearing ore or partially reduced ore that contains carbon containing reducing material. The burden is charged through ports (12) in the sides of the furnace (1). The charge ports (12) are spaced apart along the length of the furnace (1).

When the burden is charged into the furnace, heaps of burden are formed on both sides of the furnace. When enough material is charged into the furnace, the heaps on each side join up to form two rows of burden on each side of the furnace.

As disclosed in patent application PCT/EP97/01999 the charging can also be done in such a way that the two rows join up in the centre of the furnace (29), thereby completely covering the layer of slag (19) on the liquid steel (30).

During operation of the furnace in the current invention the burden will be heated by burning oxygen contained in air or otherwise, and other gasses above the burden in the furnace (not shown) and from below by the liquid steel. The steel is kept liquid by heating from the induction heaters.

The burden is reduced in its solid state. The part of the burden at the bottom and more precisely the part of the burden in contact with the pool of liquid steel (30) will be melted away. In this part of the burden reduction reactions have been completed, meaning substantially all of the carbon has been consumed. Therefore substantially no gasses are formed when the particles are melted. The melting consumes very little energy because the particles are already reduced and preheated.

Each induction heater (5) has a given length of the furnace (1) that it must service (provide with heat for melting). Hot metal exiting the induction heater (5) circulates and looses some of its heat and eventually returns as colder metal to be reheated again. There is a maximum length of liquid steel bath in a furnace that the induction heater (5) could keep in its molten state. This depends. on the throat length (20), type of steel, energy output of the induction heater, heat losses and consumption, and bath depth.

With this invention the throat length (20) is a greater percentage of the service length of the induction heater (5) in comparison with the throat lengths and service lengths of current furnaces. This leads to more efficient heat distribution. The effect is an increase in the number and a decrease in the intensity of hot spots because the heat is spread evenly along the centre line of the furnace, instead of being concentrated in one spot.

The baffles (24) aid in minimising the intensity of hotspots by distributing the hotter metal to both sides of the baffle (24), instead of directly upwards. The hotter metal is therefore forced to move along the centreline of the bath instead of directly upwards.

This means that the burden is melted away along its centre line. The effect of this is to allow particles from higher up on each side to move steadily along the slope of the burden heap towards the centre of the furnace. The problem of particles taking a shortcut is therefore minimised because the burden (2) is melted away steadily at a position farthest away from the charge ports (12).

When a suitable amount of steel has been formed in the furnace (1) it can be tapped from the furnace (1) through the tap hole (not shown). The steel can be tapped continuously at about the same rate that the particles are melted in the furnace. Slag (19) can also be tapped through the tap hole (not shown).

FIGS. 7 and 8 show another embodiment of the invention. FIG. 7 shows a section through the induction heaters (5) and throats (16) of the furnace (1A), and FIG. 8 shows a staggered plan view of the furnace (1A) in FIG. 7 along the lines 8—8.

As shown in FIG. 7 the throats (16) has in addition to the baffle (24) already shown in the embodiment disclosed in FIGS. 1 to 6, further baffles (31), (32) and (33). The additional baffles (31, 32, 33) function to direct the flow of molten metal in the throat (16). The entrance (35) to the channels (10) of the induction heaters (5) is also bevelled in the longitudinal direction to increase the area directly above the channels and to increase the distance between ascending hotter and descending cooler streams of metal.

The heated molten metal exits the passages (10) and enters the throat (16) where it first encounters the baffles (24, 33). In FIG. 7 arrows indicate the flow of metal. The lower baffles (24) diverge the metal into two streams flowing up through passages (42) formed by the baffles (24, 33). Whereas baffles (24) split the ascending hotter metal, baffles (33) serve to separate and minimise heat exchange between hotter ascending metal streams in channels (42) and cooler descending metal streams in channels (41).

The side baffles (32) further serves to separate the hotter ascending metal in area (47) from the descending cooler metal in area (45).

The two central ascending streams flowing through passages (42) flow to the area (47) from where it is divided into smaller streams that feed area (46) where melting of the reduced material takes place. The effect of this is to distribute the flow of the heated metal along the bath level (28) thereby avoiding the formation of hotspots in the bath.

The effect of the baffles is that the heat transmitted to the molten metal by the induction heaters is distributed more effectively through the whole of the service length of the induction heater. This decreases the formation of hotspots and optimises the electrical energy consumption of the furnace through better utilization of combustion energy in the furnace.

Figure 9:
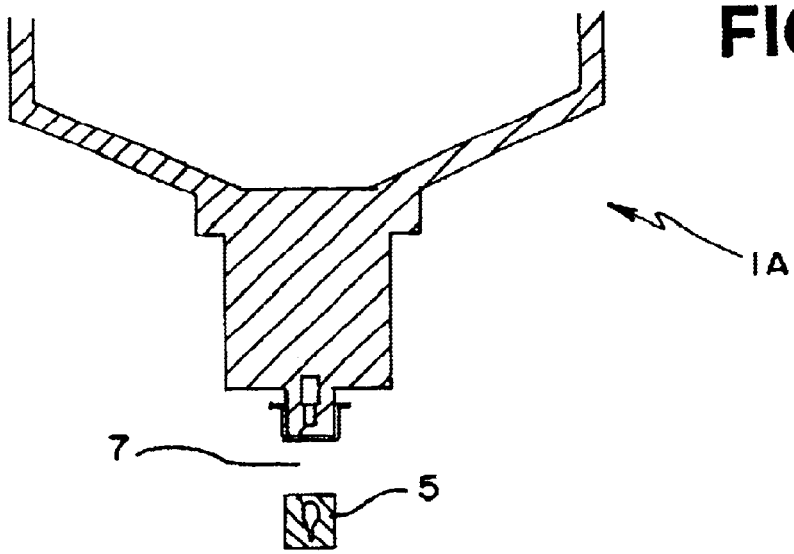
FIG. 9 is a section through 9—9 in FIG. 7.
Figure 10:
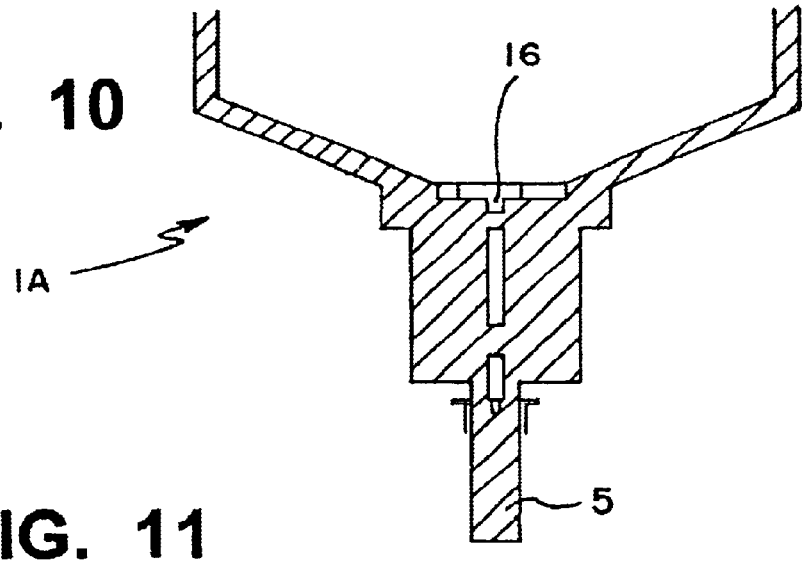
FIG. 10 is a section through 10—10 in FIG. 7.
Figure 11:
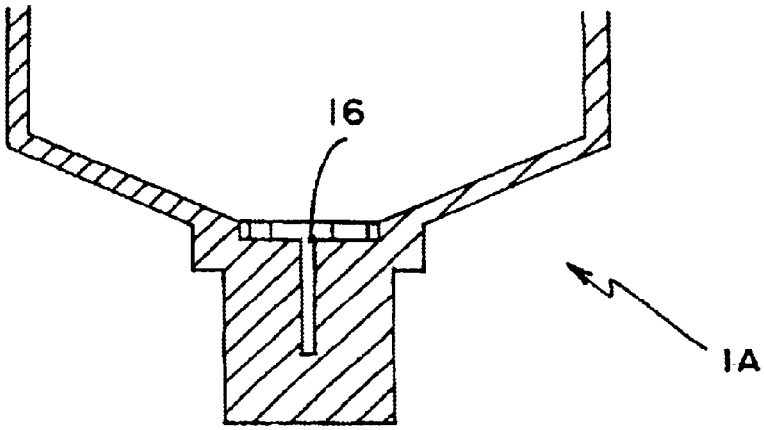
FIG. 11 is a section through 11—11 in FIG. 7.

FIGS. 9, 10 and 11 show sections through the furnace (1A) of FIG. 7 along the lines as indicated above. These figures exemplify the embodiment shown in FIGS. 7 and 8.

Figure 17:
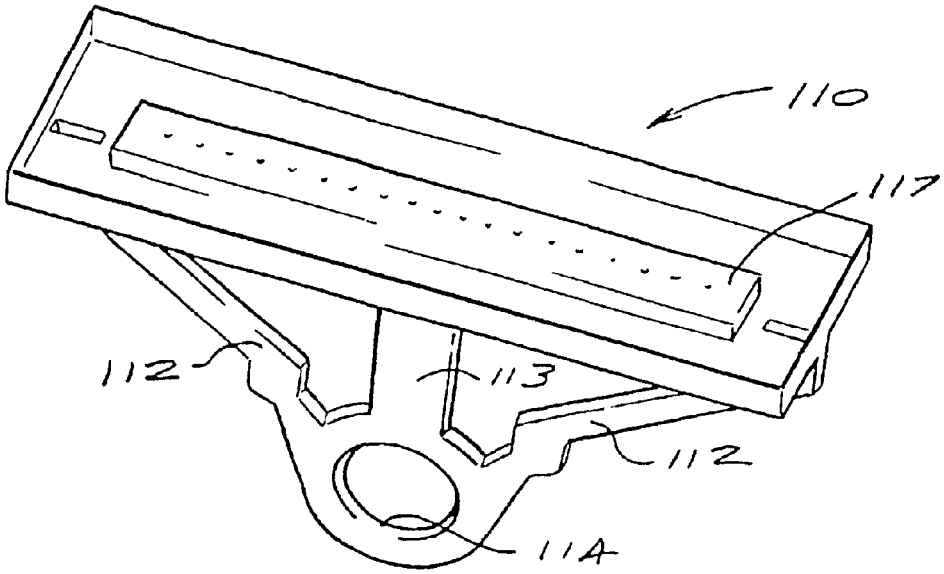
FIG. 17 is a perspective top view of a throat and a furnace floor of a second embodiment of the invention.
Figure 18:
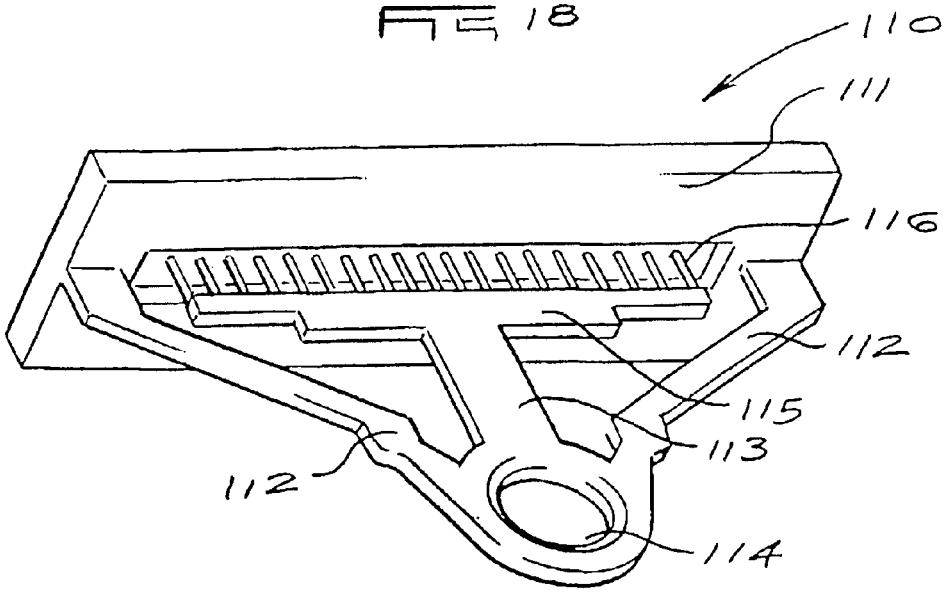
FIG. 18 is a perspective bottom view of the throat and the furnace floor of the second embodiment of the invention.

A second embodiment of the invention is shown in FIGS. 17 and 18. A throat and furnace floor is generally indicated by reference numeral (110) in FIG. 17. As shown in FIGS. 17 and 18, the molten metal is channelled through dedicated channels, which include a central channel (113) and two side channels (112).

Molten metal (not shown) is heated in the induction heater channel (114). Since the density of the heated molten metal is lower the than the density of unheated molten metal, the heated molten metal will rise through the central channel (113).

The two side channels (112) transport molten metal from the furthest reaches of the throat service length. Since the temperature of the molten metal is lower here than that of the molten metal directly above the induction heater, low temperature molten metal will be drawn in by the side channels (112). The low temperature molten metal drawn into the side channels (112) is channelled to the induction heater channel (114). The low temperature molten metal is drawn into the side channels (112) as a result of the molten metal movement caused by the rising of high temperature molten metal in the central channel (113).

As is shown in FIG. 18, it is possible for the central channel (113) to include a manifold (115) that includes manifold passages (116) extending from the manifold (115) through a raised portion (117) of the furnace floor (111). The passages (116) open at the top surface of the raised portion (117) of the furnace floor (111). This enables the high temperature molten metal to be distributed evenly in the upper region (not shown) of the molten metal bath (not shown).

Test have shown that the second embodiment depicted in FIGS. 17 and 18 is capable of achieving better heat distribution in a furnace than the first embodiment depicted in FIGS. 1 and 2.

This is primarily due to the improved flow characteristics of the molten metal in the second embodiment, which results form the use of the molten metal channels to direct the molten metal to where it can achieve the best heat distribution.

Figure 19:
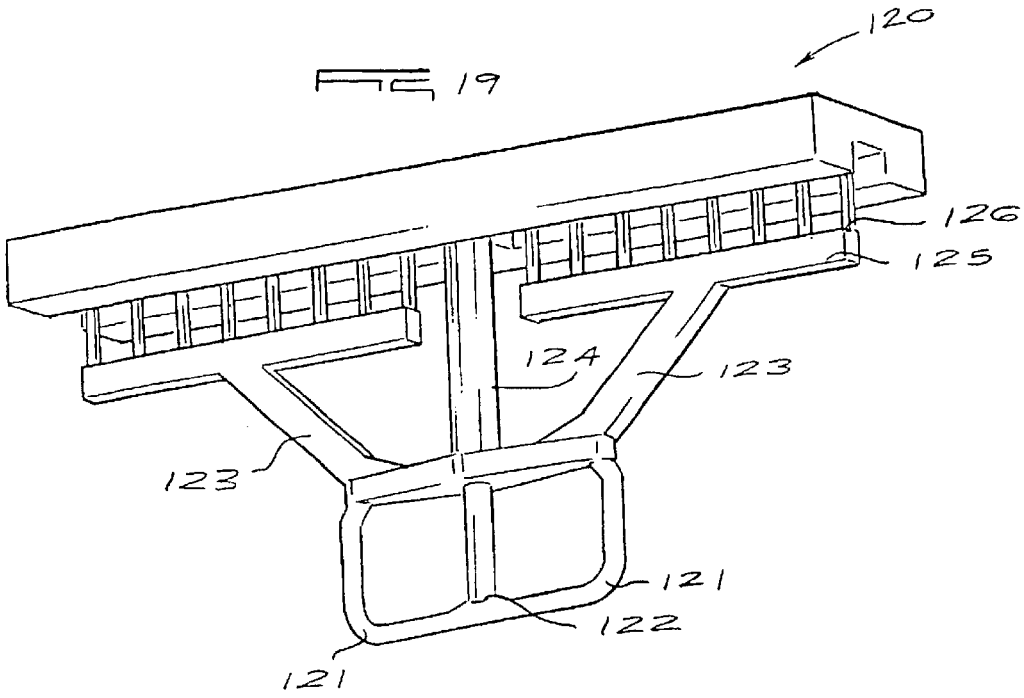
FIG. 19 is a perspective bottom view of the throat and the furnace floor of a third embodiment of the invention.
Figure 20:
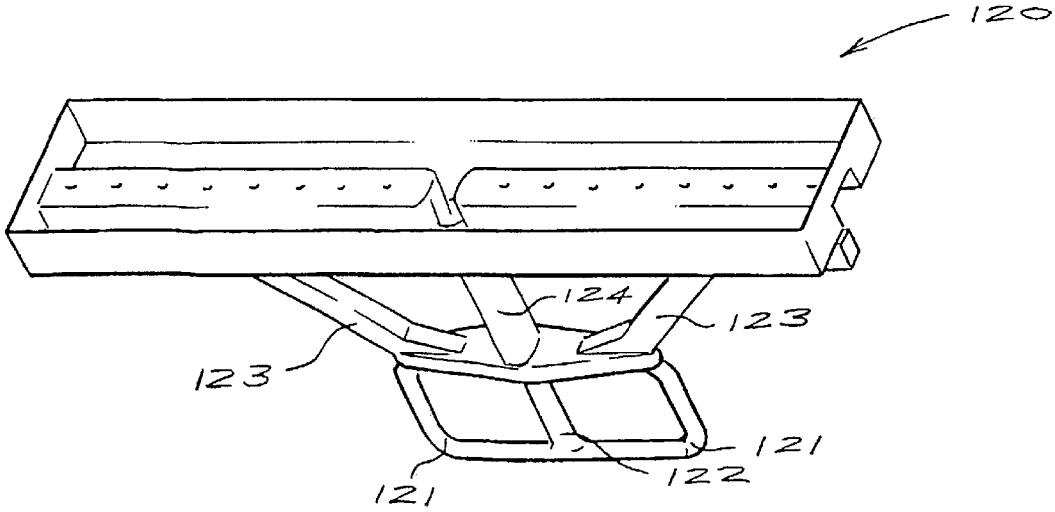
FIG. 20 is a perspective top view of a throat and a furnace floor of the third embodiment of the invention.

A third embodiment of the invention is shown in FIGS. 19 and 20. This embodiment is similar to the second embodiment. In the third embodiment a throat and furnace floor is generally indicated by reference numeral (120) in the figures.

This embodiment (120) is used with double loop induction heaters. Such an induction heater comprises two channels (121), each around a coil (not shown). The channels (121) share a single central channel (122). The direction of molten metal flow through such an induction heater is opposite to that of the second embodiment. Molten metal is drawn into the central channel (122) of the induction heater and exits it through the side channel (121) openings.

The throat has molten metal channels to match the induction heater channels. This means that there are two side molten metal channels (123) and a single central molten metal channel (124) in the throat.

The central channel (124) transports colder molten metal to the induction heater and the two side channels (123) transports heated molten metal from the throat to the bath of molten metal.

The central channel (124) does not have a manifold as in the second embodiment. Instead, the two side channels (123) each have it's own manifold (125). Each manifold (125) has a number of manifold passages (126) that connects the manifold with the molten metal bath (not shown).

The manifolds (125) of this third embodiment are shorter than the second embodiment's single manifold. The advantage of this is that the furnace has two shorter manifolds instead of one central manifold, which improves the heated metal distribution.

It will be understood that these embodiments are described by way of example only and that there are other embodiments that are also included in the scope of the invention. For instance, the number of induction heaters can be altered for a specific process. It is also possible to apply the invention to the induction melting of other metals, for example copper, brass and aluminium, or steel scrap.

It is also possible to alter the shape and configuration of the baffles shown in FIG. 7. For instance, the distance between the upper baffles can be varied and the shape of the upper baffles can be altered to be wedge-like to alter the flow pattern of the molten steel for specific circumstances.

What is claimed is:

1. An induction heated furnace comprising:

a furnace formed by a shell;

refractory material having at least walls and a floor lining portion of said shell;

at least one induction heater mounted adjacent to the refractory material floor, the induction heater communicating with the interior of the furnace through a throat of the refractory material having a length that is substantially longer than the induction heater length.

2. An induction heated furnace comprising:

a furnace formed by a shell;

refractory material having at least walls and a floor lining at least a portion of said shell;

at least one induction heater mounted adjacent to the refractory material floor, the induction heater communicating with the interior of the furnace through a throat of the refractory material wherein the throat length is more than at least one and one half of the length of the induction heater.

3. A furnace as claimed in claim 1 or 2 wherein the furnace is a channel type furnace used in the melting or smelting of metals, and the furnace has at least one burden charge hole and at least one tap hole, and further comprising at least one gas burner therein.

4. A furnace as claimed in claim 3 wherein the furnace is used for steelmaking and the at least one charge hole is for iron containing burden.

5. A furnace as claimed in claim 4 wherein the burden includes scrap metal reducing material, and raw materials.

6. A furnace as claimed in claim 5 wherein the throat has at least one baffle located substantially above the centre of the induction heater, the baffle being built into side walls of the throat for directing the flow of molten metal through the throat.

7. A furnace as claimed in claim 6 wherein a plurality of baffles are located in the throat, the baffles being spaced apart.

8. A furnace as claimed in claim 7 wherein each baffle is wedge shaped and the wedge is located in the throat with the apex of the wedge directed at the centre of the induction heater.

9. A furnace as claimed in claim 8 wherein at least a portion of at least one baffle operatively extends above the molten metal level in the furnace.

10. A furnace as claimed in claim 9 wherein at least one of the baffles has a cooling conduit there through.

11. A furnace as claimed in claim 3 in which the throat comprises at least two throat passages, the first passage communicating with a first portion of the molten bath above the induction heater, and the second passage communicating with a second portion of the molten bath remote from the first portion of the molten bath.

12. A furnace as claimed in claim 11 in which the first throat passage operatively directs molten metal from the induction heater to the molten bath, and the second throat passage operatively transports molten metal from the molten bath to the induction heater.

13. A furnace as claimed in claim 12 in which an operatively upper end of the first throat passage includes a manifold, and the manifold is connected to a plurality of manifold passages, the manifold passages communicating with an upper region of the first portion of the molten bath.

14. A furnace as claimed in claim 13 in which the manifold passages extend through a raised portion of the furnace floor.

15. A furnace as claimed in claim 11 in which the first throat passage operatively directs molten metal from the molten bath to the induction heater, and the second throat passage operatively transports molten metal from the induction heater to the molten metal bath.

16. A furnace as claimed in claim 15 in which the operatively upper end of the second throat passage includes a manifold, and the manifold is connected to a plurality of manifold passages, the manifold passages communicating with the operatively upper region of the second portion of the molten bath.

17. A furnace as claimed in claim 16 in which the manifold passages extend through a raised portion of the furnace floor.

18. A furnace as claimed in claim 11 wherein the throat further comprises a third throat passage, the third throat passage communicating with a third portion of the molten bath remote from the first portion of the molten bath, and the first portion of the molten bath remote is located between the second and third portions of the molten bath.

19. A furnace as claimed in claim 18 in which the first throat passage operatively directs molten metal from the induction heater to the molten bath, and the second and third throat passages operatively transport metal from the molten bath to the induction heater.

20. A furnace as claimed in claim 19 in which the operatively upper end of the first throat passage includes a manifold, and the manifold is connected to a plurality of manifold passages, the manifold passages communicating with the operatively upper region of the first portion of the molten bath.

21. A furnace as claimed in claim 20 in which the manifold passages extend through a raised portion of the furnace floor.

22. A furnace as claimed in claim 18 in which the first throat passage operatively directs molten metal from the molten bath to the induction heater, and the second and third throat passages operatively transport molten metal from the induction heater to the molten metal bath.

23. A furnace as claimed in claim 22 in which the operatively upper end of the second throat passage includes a manifold and the operatively upper end of the third throat passage includes a manifold, the second and third throat passage manifolds are connected to a plurality of manifold passages, the second throat manifold passages communicate with the operatively upper region of the second portion of the molten bath and the third throat manifold passages communicate with the operatively upper region of the third portion of the molten bath.

24. A furnace as claimed in claim 23 in which the second throat manifold passages and the third throat manifold passages extend through a raised portion of the furnace refractory material floor.

25. A furnace as claimed in claim 1 wherein the upper ends of the walls of refractory material are spaced from the top of the furnace shell and the length of the throat is the distance between the upper ends of the walls of the refractory material and the length of the induction heater is that of an opening in the floor of the refractory material where the induction heater is mounted.

26. A furnace as claimed in claim 2 wherein the upper ends of the walls of the refractory material are spaced from the top of the furnace shell and length of the throat is the distance between the upper ends of the walls of the refractory material and the length of the induction heater is that of an opening in the floor of the refractory material where the induction heater is mounted.

* * * * *